US012729602B2

(12) United States Patent
Goodman

(10) Patent No.: US 12,729,602 B2
(45) Date of Patent: Sep. 8, 2026

(54) HYDROSTATICALLY INSENSITIVE VALVE ASSEMBLY

(71) Applicant: Weatherford Technology Holdings, LLC., Houston, TX (US)

(72) Inventor: Brandon C. Goodman, Houston, TX (US)

(73) Assignee: Weatherford Technology Holdings, LLC., Houston, TX (US)

( * ) Notice: Subject to any disclaimer, the term of this patent is extended or adjusted under 35 U.S.C. 154(b) by 68 days.

(21) Appl. No.: 18/628,028

(22) Filed: Apr. 5, 2024

(65) Prior Publication Data

US 2025/0314152 A1 Oct. 9, 2025

Related U.S. Application Data

(60) Provisional application No. 63/574,379, filed on Apr. 4, 2024.

(51) Int. Cl.
*E21B 34/10* (2006.01)
*E21B 34/08* (2006.01)

(52) U.S. Cl.
CPC ..... *E21B 34/10* (2013.01); *E21B 34/08* (2013.01); *E21B 2200/06* (2020.05)

(58) Field of Classification Search
CPC ..... E21B 34/10; E21B 34/101; E21B 34/08; E21B 34/06; E21B 34/00; E21B 2200/06
See application file for complete search history.

(56) References Cited

U.S. PATENT DOCUMENTS 10,107,072 B2 10/2018 Harris et al.
10,156,124 B2 12/2018 Guzman et al.
10,920,525 B2 2/2021 Tveranger
11,702,904 B1 7/2023 Anton et al.
2019/0063183 A1* 2/2019 Anton ..... E21B 34/102
2019/0195048 A1* 6/2019 Tveranger ..... E21B 34/142
2019/0203550 A1 7/2019 Geoffroy
2019/0203559 A1 7/2019 Ezell et al.
2020/0157917 A1* 5/2020 Olguin ..... E21B 23/006
2022/0364438 A1 11/2022 Mackay

OTHER PUBLICATIONS

PCT International Search Report & Written Opinion pertaining to International Application No. PCT/US2025/021780; Date of Mailing: Jun. 24, 2025.

* cited by examiner

*Primary Examiner* — George S Gray
(74) *Attorney, Agent, or Firm* — Vorys, Sater, Seymour and Pease LLP

(57) ABSTRACT

A pressure-operated valve assembly includes an outer mandrel defining a tubing string bore, an inner mandrel arranged within the tubing string bore, a first atmospheric chamber at least partially defined by the outer mandrel, and a second atmospheric chamber at least partially defined between the outer and inner mandrels. A valve chamber is defined in the inner mandrel and in fluid communication with the tubing string bore via a valve port and with a wellbore annulus via an annulus port. An atmospheric chamber port is provided in the valve chamber and in fluid communication with the second atmospheric chamber. A hydrostatically insensitive valve is arranged within the valve chamber and includes a piston providing a head exposed to both annulus and tubing string bore pressure, and movable to expose the atmospheric chamber port to flood the second atmospheric chamber and simultaneously cause the first atmospheric chamber to collapse.

20 Claims, 4 Drawing Sheets

HYDROSTATICALLY INSENSITIVE VALVE ASSEMBLY

FIELD OF THE DISCLOSURE

The present disclosure relates generally to pressure-operated valve assemblies for downhole use and, more particularly, to a hydraulically insensitive valve assembly that balances out atmospheric forces imposed on the valve assembly.

BACKGROUND OF THE DISCLOSURE

In the oil and gas industry, wellbores are drilled into subterranean formations to access hydrocarbon reserves. These wellbores typically extend vertically for long distances into the subsurface but also have been drilled to deviate from the vertical and, at times, to extend horizontally. During the drilling process, drilling is often suspended so that lengths of tubular casing can be lowered into the well to line the wellbore, maintain well integrity, and prevent the well from collapsing. The casing is then cemented into place, and drilling can then continue to extend the well still further until the subsurface target is reached.

Upon reaching a target depth, completion equipment is extended into the wellbore and conventionally includes pressure-operated valves designed for controlling fluid flow between the interior of the completion tubing and the surrounding annulus defined between the wall of the wellbore and the outer surface of the completion tubing. When the downhole pressure reaches a certain threshold, the pressure-operated valve opens, allowing fluid flow in or out of the completion string.

Some pressure-operated valves include burst ports or disks that open into closed (atmospheric) chambers and require functional considerations and job planning to take hydrostatic pressure into account. Oftentimes burst disks must be selected prior to the job based on known or predicted downhole pressures. This requires well operators to store extra inventory and rely on manufacturing and district shops to install the correct value burst disk. This can be problematic if something operationally changes between assembly and running the completion string downhole. Additionally, burst disks in pressure-operated valves are subjected to the collapse pressure of the atmospheric chamber. Consequently, if the burst disk fails prematurely, this may result in substantial operation costs for remediation.

What is needed is a pressure-operated valve that circumvents the foregoing logistical hurdles with a one size fits all configuration that eliminates the additional pressure constraints imposed by closed atmospheric chambers.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a pressure-operated valve assembly is disclosed and includes an outer mandrel defining a tubing string bore, wherein an annulus is defined between the outer mandrel and an inner wall of a wellbore when arranged within the wellbore, an inner mandrel arranged within the tubing string bore, a first atmospheric chamber at least partially defined by the outer mandrel, and a second atmospheric chamber at least partially defined between the outer and inner mandrels, a valve chamber defined in the inner mandrel and in fluid communication with the tubing string bore via a valve port and further in fluid communication with the annulus via an annulus port, an atmospheric chamber port provided in the valve chamber and in fluid communication with the second atmospheric chamber via a chamber conduit, and a hydrostatically insensitive valve arranged within the valve chamber and including a piston providing a head with a first end exposed to pressure within the annulus via the annulus port and a second end exposed to pressure within the tubing string bore via the valve port. The piston is movable between a first position, where the head occludes the atmospheric chamber port, and a second position, where the atmospheric chamber port is exposed and thereby allows fluid pressure within the valve chamber to communicate with the second atmospheric chamber via the chamber conduit. Communicating the fluid pressure to the second atmospheric chamber causes the first atmospheric chamber to collapse.

According to another embodiment consistent with the present disclosure, a method is disclosed and includes the step of conveying a pressure-operated valve assembly into a wellbore, the pressure-operated valve assembly including an outer mandrel defining a tubing string bore, and an inner mandrel arranged within the tubing string bore, a first atmospheric chamber at least partially defined by the outer mandrel, and a second atmospheric chamber at least partially defined between the outer and inner mandrels, a valve chamber defined in the inner mandrel and in fluid communication with the tubing string bore via a valve port and further in fluid communication with an annulus defined between the outer mandrel and an inner wall of the wellbore via an annulus port, an atmospheric chamber port provided in the valve chamber and in fluid communication with the second atmospheric chamber via a chamber conduit, and a hydrostatically insensitive valve arranged within the valve chamber and including a piston providing a head with a first end exposed to pressure within the annulus via the annulus port and a second end exposed to pressure within the tubing string bore via the valve port. The method may further include the steps of increasing a pressure within the tubing string bore and thereby moving the piston from a first position, where the head occludes the atmospheric chamber port, and a second position, where the atmospheric chamber port is exposed, communicating fluid pressure from the valve chamber to the second atmospheric chamber via the chamber conduit, and collapsing the first atmospheric chamber.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1A:
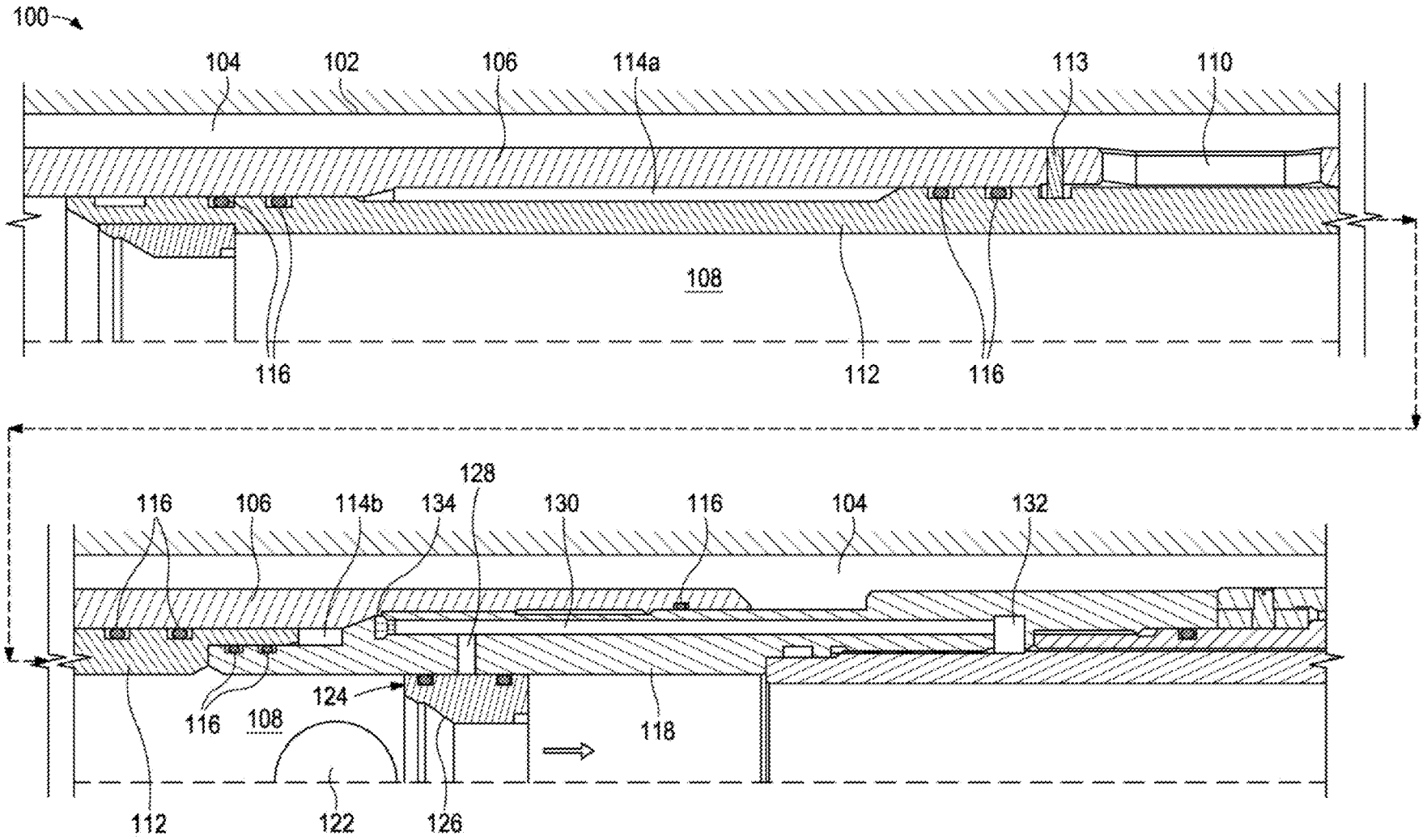
FIG. 1A (PRIOR ART)
FIG. 1A is a cross-sectional side view of a prior art pressure-operated valve assembly and FIG. 1B is a cross-sectional side view of a pressure-operated valve assembly including a hydrostatically insensitive valve that may incorporate the principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to pressure-operated valve assemblies for downhole use and, more particularly, to a hydraulically insensitive valve assembly that balances out atmospheric forces imposed on the valve assembly. The valve assemblies described herein may prove advantageous in allowing a single, universal valve capable of being run downhole to depth in all applications, without the need for field or district configuration to a prescribed operational depth. Historically, burst disks have been utilized to flood closed atmospheric chambers at a prescribed pressure, and valve systems have been utilized to change fluid flow and pressure dynamics within an open system. The embodiments disclosed herein employ hydraulically insensitive valve assemblies as a type of rupture mechanism to flood an atmospheric chamber for the purpose of de-balancing a valve piston and potentially functioning a tool (e.g., a sliding sleeve).

FIG. 1A is a cross-sectional side view of a prior art pressure-operated valve assembly 100 that may incorporate the principles of the present disclosure. The pressure-operated valve assembly 100 (hereafter "the assembly 100") may be arranged and used within a wellbore 102 drilled from a well surface location and penetrating one or more subterranean formations. The wellbore 102 may be lined with a string of casing or a liner (not shown) but could alternatively be "open hole". In some applications, the assembly 100 may form part of a completion string or completion tubing extended into the wellbore 102 for a variety of purposes, such as completing the well (e.g., cementing a portion of the well), undertaking a wellbore stimulation operation (e.g., hydraulic fracturing, acidizing, etc.), preparing for hydrocarbon production, well remediation, well re-stimulation, well decommissioning, etc. In such embodiments, the assembly 100 forms part of the completion tubing and communicates with the interior of the completion string. When the assembly 100 is arranged within the wellbore 102, an annulus 104 is defined between the assembly 100 and the inner wall (inner radial surface) of the wellbore 102.

As illustrated, the assembly 100 includes an outer housing or "mandrel" 106. The outer mandrel 106 may generally comprise a tubular member that defines an interior or "tubing string bore" 108 that communicates with the interior of an interconnected completion tubing (string). In some applications, the outer mandrel 106 may comprise a single, monolithic length of tubing, but may alternatively comprise two or more lengths of tubing operatively coupled to each other to form the outer mandrel 106. One or more ports 110 are defined in the sidewall of the outer mandrel 106 and, upon actuation of the assembly 100, fluids may be communicated through the ports 110 from the tubing string bore 108 into the annulus 104, or from the annulus 104 into the tubing string bore 108, depending on the operation undertaken. In some applications, for example, the ports 110 may be used to discharge (convey) cement into the annulus 104 to secure casing within the wellbore 102. In other applications, the ports 110 may be used for hydraulic fracturing or production operations.

In some applications, the assembly 100 can include a sliding sleeve 112 arranged within the tubing string bore 108 and positioned radially adjacent the ports 110. During operation of the assembly 100, the sliding sleeve 112 is movable (slidable) between a first or "closed" position, where the sliding sleeve 112 occludes the ports 110, and a second or "open" position, where the ports 110 are exposed. The sliding sleeve 112 is shown in FIG. 1A in the closed position, thereby preventing fluids from entering or exiting the tubing string bore 108 via the ports 110. Upon moving to the open position, fluids will be able to flow through the ports 110 in either direction. In some applications, the sliding sleeve 112 may be prevented from inadvertently shifting from the closed position to the open position with one or more shear pins 113. The shear pin 113 helps prevent the sliding sleeve 112 from shifting as the assembly 100 is conveyed downhole and is rated to shear upon assuming a predetermined (shear) load, which allows the sliding sleeve 112 to move to the open position.

Besides the shear pin 113, the sliding sleeve 112 is also pressure balanced, which helps maintain the sliding sleeve 112 in the closed position while the assembly is conveyed into the wellbore 102. More specifically, the assembly 100 provides and otherwise defines a first atmospheric chamber 114*a* located uphole from the ports 110, and a second atmospheric chamber 114*b* located downhole from the ports 110. In other applications, the atmospheric chambers 114*a,b* can both be positioned on one side of the ports 110. As their names suggest, the first and second atmospheric chambers 114*a,b* exhibit a pressure at or near atmospheric pressure. Consequently, as the assembly 100 is conveyed downhole within the wellbore 102 (commonly referred to as run-in-hole or "RIH"), equilibrium between the atmospheric chambers 114*a,b* prevents the sliding sleeve 112 from being acted upon in either direction (e.g., uphole or downhole), thus helping to maintain the sliding sleeve 112 in the closed position.

As illustrated, the first atmospheric chamber 114*a* is defined between the outer mandrel 106 and the sliding sleeve 112, and is sealed at both ends using one or more seals 116 (e.g., O-rings) arranged at corresponding interfaces between the outer mandrel 106 and the sliding sleeve 112. The second atmospheric chamber 114*b* is defined between a combination of the outer mandrel 106, an end of the sliding sleeve 112, and an inner mandrel 118 arranged within the tubing string bore 108 downhole from the sliding sleeve 112. The second atmospheric chamber 114*b* is sealed at both ends using one or more seals 116 (e.g., O-rings). In the illustrated application, a first pair of seals 116 is provided at an interface between the sliding sleeve 112 and the outer mandrel 106, a second pair of seals 116 is provided at an interface between the sliding sleeve 112 and the inner mandrel 118, and at least one additional seal 116 is provided at an interface between the outer and inner mandrels 106, 118 downhole from the second atmospheric chamber 114*b*. The seals 116 help to ensure that the sliding sleeve 112 is pressure balanced as the assembly 100 is conveyed downhole.

When it is desired to actuate the assembly 100 and otherwise move the sliding sleeve 112 from the closed position to the open position, the second atmospheric chamber 114*b* must be exposed and otherwise flooded with pressurized fluid. Flooding the second atmospheric chamber 114*b* will eliminate the pressure balance across the sliding sleeve 112, thereby causing the first atmospheric chamber 114*a* to collapse and simultaneously move the sliding sleeve 112 to the open position where the ports 110 become exposed to the tubing string bore 108. In the illustrated application, this process can be accomplished by first conveying a wellbore projectile 122 downhole and into the tubing string bore 108 of the outer mandrel 106. The wellbore projectile 122 can comprise, for example, a ball or a dart. The assembly 100 includes a sliding projectile sleeve 124 that defines a landing seat 126 sized to receive the wellbore projectile 122. Once the wellbore projectile 122 locates and is received on the landing seat 126, pressure within the tubing string bore 108 is increased to move (slide) the sliding projectile sleeve 124 downhole.

Moving the sliding projectile sleeve 124 downhole exposes a valve port 128 defined in the inner mandrel 118, and the valve port 128 facilitates fluid communication with a valve chamber 130. In some embodiments, the valve chamber 130 may be defined in the inner mandrel 118. In other embodiments, however, the valve chamber 130 may be cooperatively defined between the inner mandrel 118 and the outer mandrel 106. Once the valve port 128 is exposed, pressure from within the tubing string bore 108 may be conveyed into the valve chamber 130. In some applications, one end of the valve chamber 130 (e.g., the downhole end) may communicate with a through port 132 that is in fluid communication with a downhole tool or mechanism (not shown). The downhole mechanism may comprise, for example, a packer, such as an inflatable packer assembly that requires fluid pressure to actuate. In applications that include the downhole mechanism, increasing the pressure within the tubing string bore 108 will correspondingly increase the pressure within the valve chamber 130. Once the pressure within the valve chamber 130 reaches a predetermined pressure (e.g., a first predetermined pressure), the downhole mechanism will be actuated. In other applications, however, the through port 132 and the associated downhole tool or mechanism may be omitted, and exposing the valve port 128 merely pressurizes the valve chamber 130.

The assembly 100 includes a burst disk 134 arranged within the valve chamber 130. The burst disk 134 provides a barrier between the valve chamber 130 and the second atmospheric chamber 114*b*. As long as the burst disk 134 remains intact, the second atmospheric chamber 114*b* will remain undisturbed. However, once the burst disk 134 ruptures, fluid communication between the valve chamber 130 and the second atmospheric chamber 114*b* is facilitated.

The burst disk 134 is rated to rupture at a second predetermined pressure. In some applications, the second predetermined pressure is the same as the first predetermined pressure required to actuate the downhole mechanism, but could alternatively comprise a pressure greater than the first predetermined pressure. Once the second (or first) predetermined pressure is reached, the burst disk 134 will rupture, thereby allowing fluid pressure to enter and flood the second atmospheric chamber 114*b*. Being at atmospheric pressure, the first atmospheric chamber 114*a* will collapse after the shear pin 113 shears, thus causing the sliding sleeve 112 to shift to the open position and exposing the ports 110.

At least one challenge presented by the burst disk 134 is that it requires the well operator to know exactly what the hydrostatic pressure is at the setting depth for the assembly 100, and select the burst disk 134 with a proper burst rating. If the assembly 100 is already built with a burst disk that is not properly rated, the assembly 100 will have to be disassembled on site to replace the burst disk with the correct (i.e., properly rated) burst disk. As will be appreciated, this process requires time and money.

Figure 1B:
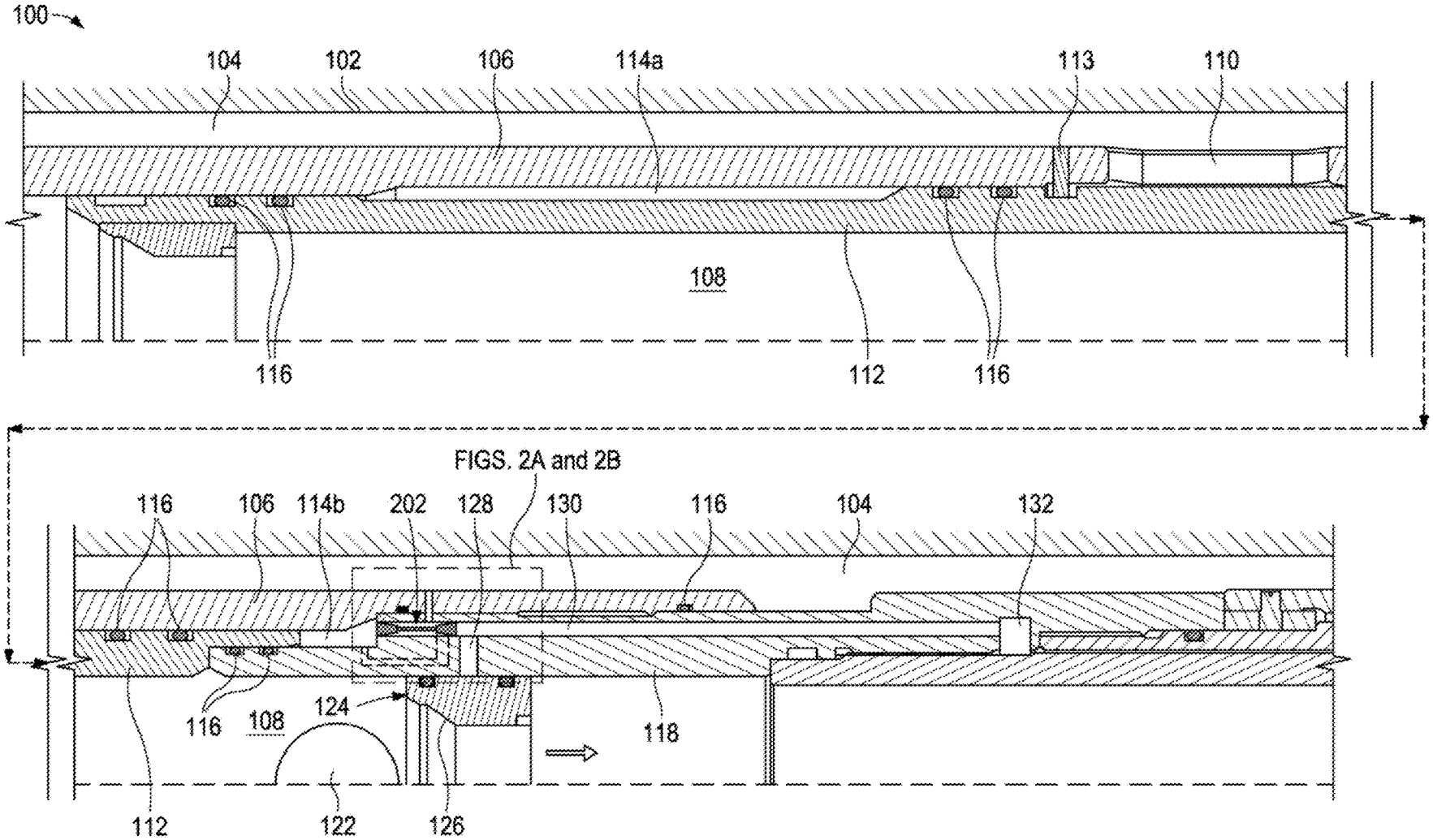

According to embodiments of the present disclosure, the assembly 100 may be modified and otherwise include a hydrostatically insensitive valve 202 as illustrated in FIG. 1B. The hydrostatically insensitive valve 202 may be disposed within the valve chamber 130 adjacent the second atmospheric chamber 114*b* as described in greater detail below with reference to FIGS. 2A and 2B. As described herein, the configuration of the hydrostatically insensitive valve 202 balances out atmospheric forces imposed on the valve mechanism, thereby allowing a well operator to use one universal valve run from surface to depth in all applications without the need for field or district configuration to a prescribed operational depth. Each of the other features identified with reference numerals may operate as described with reference to FIG. 1A above.

Figure 2A:
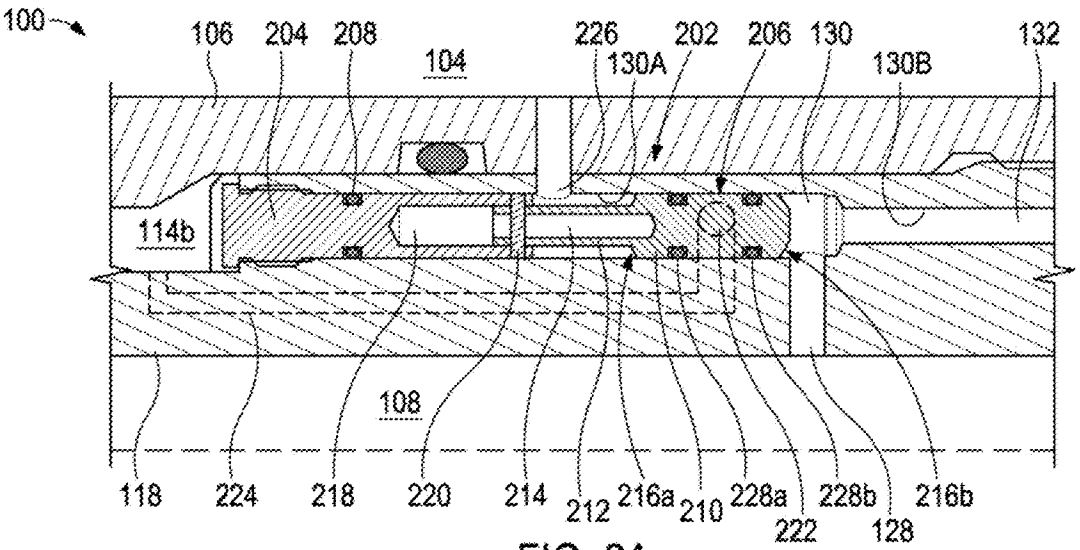
FIGS. 2A and 2B are enlarged, cross-sectional views of a portion of the pressure-operated valve assembly of FIG. 1B showing an example hydrostatically insensitive valve, according to one or more embodiments of the present disclosure.
Figure 2B:
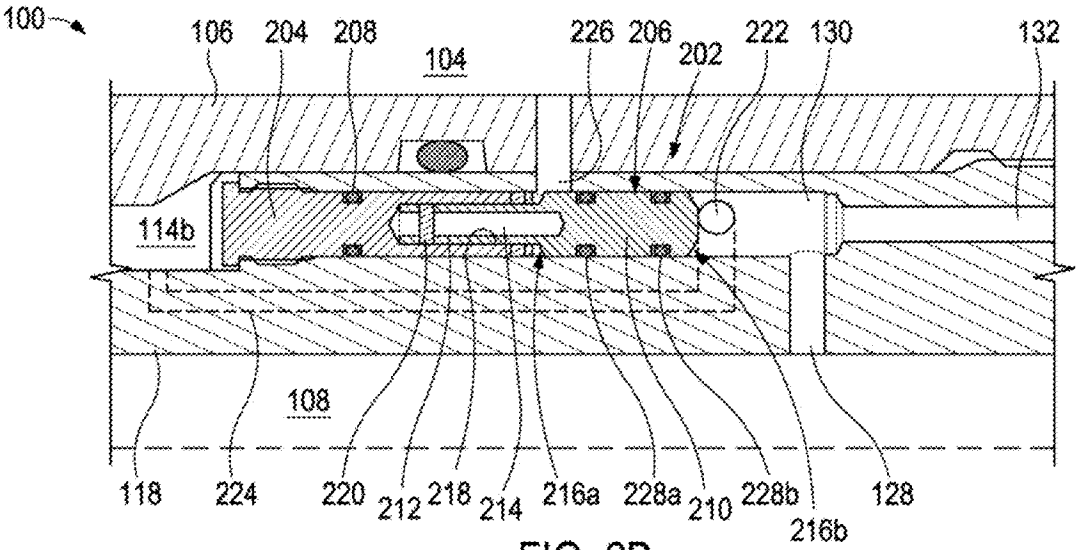

FIGS. 2A and 2B are enlarged, cross-sectional views of a portion of the assembly 100 showing an example hydrostatically insensitive valve 202, according to one or more embodiments of the present disclosure. More specifically, FIGS. 2A-2B depict an enlarged view of the valve chamber 130 defined in the inner mandrel 118, and the hydrostatically insensitive valve 202 (hereafter "the valve 202") is arranged or installed within the valve chamber 130.

As illustrated, the valve 202 includes a plug 204 and a piston 206. The plug 204 may be secured within the valve chamber 130, and the piston 206 may be movable (actuatable) within the valve chamber 130 relative to the plug 204, which remains stationary. In some embodiments, the plug 204 may be secured within the valve chamber 130 via a threaded engagement, but could alternatively be secured via other mechanical interfaces. The plug 204 may be arranged within the valve chamber 130 such that it structurally interposes the second atmospheric chamber 114*b* and the piston 206. In at least one embodiment, one or more seals 208 (e.g., O-rings) may be arranged to seal an interface between the plug 204 and the inner wall of the valve chamber 130. The seals 208 may help ensure that fluid pressure within the valve chamber 130 does not inadvertently migrate into the second atmospheric chamber 114*b* prematurely.

As illustrated, the piston 206 includes a head 210 and a stem 212 extending from the head 210. In some embodiments, as illustrated, the stem 212 may be rifle drilled and otherwise define an internal cavity 214. The head 210 provides opposing first and second ends 216*a* and 216*b*, and the stem 212 extends from the first end 216*a*. The plug 204 may provide or otherwise define an elongate channel 218 sized to receive the stem 212. The internal cavity 214 may help fluid to escape the channel 218 as the piston 206 advances into the channel, thereby preventing hydraulic lock.

In some embodiments, as illustrated, the piston 206 may be operatively coupled to the plug 204 using a shearable member 220 extendable (at least partially) through the stem 212. In some embodiments, as illustrated, the shearable member 220 may comprise a shear pin, but could alternatively comprise any other mechanical fastener that may be shearable (actuatable) at a known limit. Once the head 210 assumes a sufficient pressure load, the shearable member 220 may be sheared to allow the piston 206 to move within the valve chamber 130 from a first position, as shown in FIG. 2A, to a second position, as shown in FIG. 2B. In the first position, the head 210 occludes an atmospheric chamber port 222 that fluidly communicates with the second atmospheric chamber 114*b* via a communication channel or "chamber conduit" 224 (shown in dashed lines). In the second position, the piston 206 has moved within the valve chamber such that the stem 212 is received within the channel 218 and the atmospheric chamber port 222 becomes exposed, thereby allowing fluid pressure within the valve chamber 130 to fluidly communicate with the second atmospheric chamber 114*b* via the chamber conduit 224.

The piston 206 effectively divides the valve chamber 130 into a first or "annulus" side 130A and a second or "tubing bore" side 130B. The annulus side 130A is in fluid communication with the annulus 104 via an annulus port 226, and the tubing bore side 130B is in fluid communication with the tubing string bore 108 via valve port 128. Accordingly, the first end 216*a* may be exposed to fluid pressure in the annulus 104 via the annulus port 226, which places the valve chamber 130 in fluid communication with the annulus 104 uphole from the first end 216*a*. In some embodiments, the annulus port 226 is defined only in the inner mandrel 118. In other embodiments, however, the annulus port 226 may be cooperatively defined in both the inner mandrel 118 and the outer mandrel 106 via aligned and contiguous conduits. In the illustrated embodiment, the annulus port 226 extends through contiguous conduits defined in both the inner mandrel 118 and the outer mandrel 106. The second end 216*b* may be exposed to fluid pressure in the tubing string bore 108 via the valve port 128.

Since the first end 216*a* fluidly communicates with the annulus 104, and the second end 214*b* fluidly communicates with the tubing string bore 108, and since the fluid pressure within the annulus 104 and the tubing string bore 108 will be substantially the same as the assembly 100 is conveyed downhole, the valve 202 will be pressure balanced across the piston 206 during RIH. This is particularly applicable when the sliding projectile sleeve 124 (FIG. 1B) is not included in the assembly 100. Moreover, in some embodiments, the valve 202 may include one or more first and second seals 228*a* and 228*b* (e.g., O-rings) arranged to seal an interface between the head 210 and the valve chamber 130. When the piston 206 is in the first position, as shown in FIG. 2A, the first and second seals 228*a,b* will be arranged on opposing sides of the atmospheric chamber port 222, thereby balancing the pressure across the atmospheric chamber port 222. In some cases, there could be some suction on the atmospheric chamber port 222 from the second atmospheric chamber 114*b* as the assembly 100 is conveyed downhole, but the first and second seals 228*a,b* are balanced, thereby preventing any fluid migration in or out of the atmospheric chamber port 222. Moreover, this may prove advantageous in helping to eliminate preload on the shearable member 220 from the second atmospheric chamber 114*b*, thus converting the valve 202 into a "hydrostatically insensitive" valve.

Example operation of the valve 202 will now be provided, with continued reference to the assembly 100 in FIG. 1B. When it is desired to actuate the assembly 100 and move the sliding sleeve 112 from the closed position to the open position, the second atmospheric chamber 114*b* will need to be exposed and otherwise flooded with pressurized fluid. To accomplish this, the valve 202 may be actuated and, more particularly, the piston 206 may be moved from the first position (FIG. 2A) to the second position (FIG. 2B). In embodiments that include the sliding projectile sleeve 124 (FIG. 1B), moving the piston 206 to the second position will first require that the sliding projectile sleeve 124 be moved to expose the valve port 128, thus allowing fluid pressure to act on the piston 206 and move the piston to the second position. As described above, this can be accomplished by conveying the wellbore projectile 122 downhole until locating the landing seat 126 of the sliding projectile sleeve 124, and subsequently increasing the pressure within the tubing string bore 108 to move the sliding projectile sleeve 124 and expose the valve port 128. In embodiments where the sliding projectile sleeve 124 is omitted, however, fluid pressure can be applied on the piston 206 directly from the tubing string bore 108 and through the valve port 128, which remains exposed.

With the valve port 128 exposed, pressure from within the tubing string bore 108 may be conveyed into the valve chamber 130. In some applications, a portion of the fluid pressure conveyed into the valve chamber 130 may be conveyed through the through port 132 in fluid communication with a downhole tool or mechanism (not shown), as generally described above. In other applications, or in addition thereto, the fluid pressure conveyed into the valve chamber 130 may act on the second end 216*b* of the head 210 of the piston 206.

The fluid pressure within the valve chamber 130 may be increased until reaching a predetermined pressure corresponding to the shear limit of the shearable member 220. Until the piston 206 is moved, the second atmospheric chamber 114*b* remains locked out, and any attempt to collapse the second atmospheric chamber 114*b* will not have any effect on the shearable member 220. Upon reaching the predetermined pressure, however, the shearable member 220 will shear and thereby free the piston 206 to move within the valve chamber 130 to the second position, as shown in FIG. 2B. The atmospheric chamber port 222 becomes exposed once the piston 206 moves to the second position, thereby allowing fluid pressure within the valve chamber 130 to fluidly communicate with and flood the second atmospheric chamber 114*b* via the chamber conduit 224. Flooding the second atmospheric chamber 114*b* will eliminate the pressure balance across the sliding sleeve 112 and thereby cause the first atmospheric chamber 114*a* to collapse after the shear pin 113 (FIG. 1B) shears, thus causing the sliding sleeve 112 to shift to the open position where the ports 110 become exposed to the tubing string bore 108.

Figure 3:
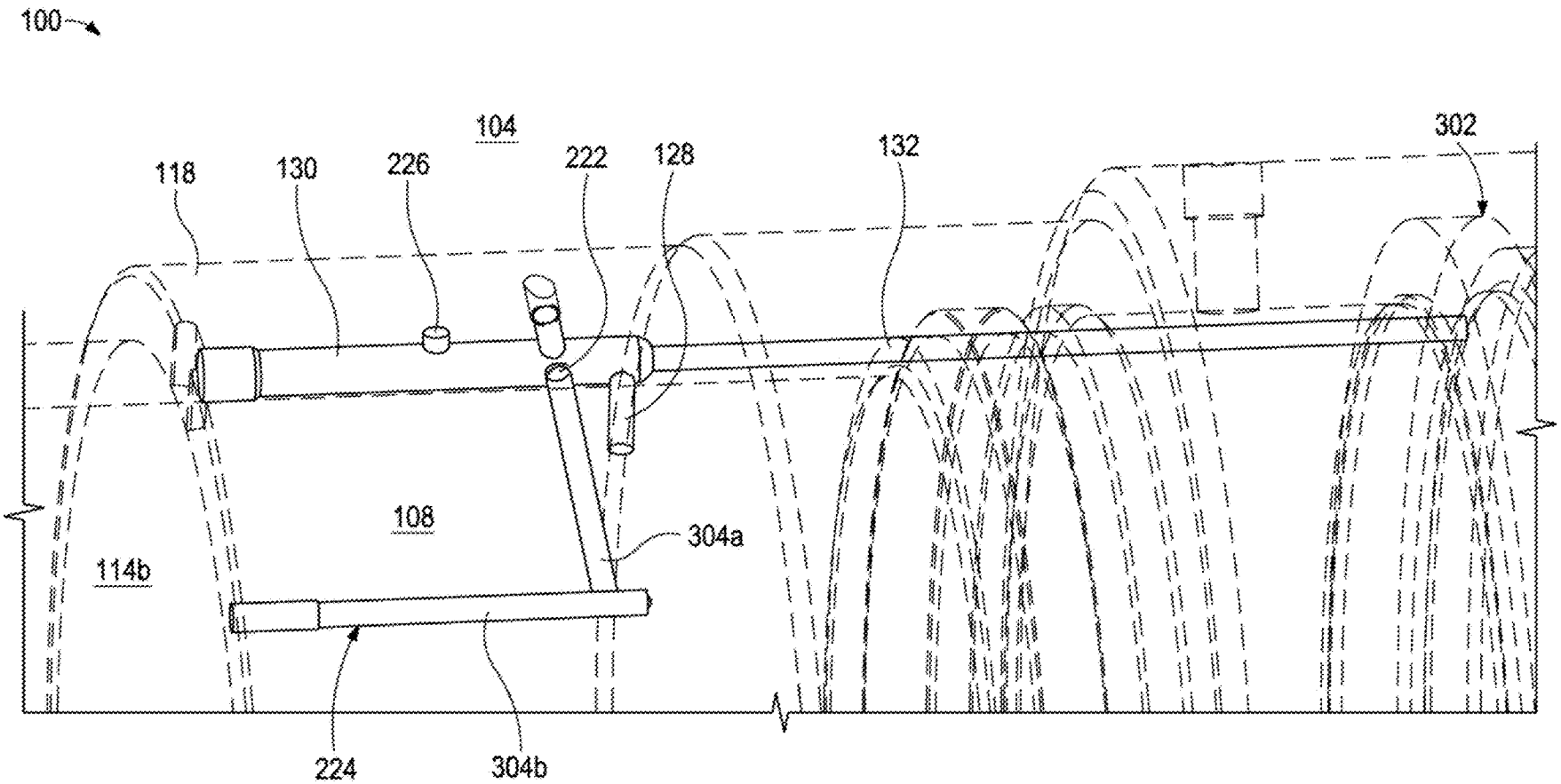
FIG. 3 is a three-dimensional, schematic view of a portion of the pressure-operated valve assembly of FIGS. 2A-2B, according to one or more embodiments.

FIG. 3 is a three-dimensional, schematic view of a portion of the assembly 100, according to one or more embodiments. As illustrated, the valve chamber 130 is defined in a sidewall of the inner mandrel 118 and the through port 132 extends from the valve chamber 130 and terminates at a downhole mechanism 302 (e.g., an inflatable packer). Moreover, the atmospheric chamber port 222 fluidly communicates with the second atmospheric chamber 114*b* via the chamber conduit 224, which may also be defined in the sidewall of the inner mandrel 118. In at least one embodiment, as illustrated, the chamber conduit 224 may include two intersecting conduits; e.g., a first conduit 304*a* that extends a short distance from the valve chamber and about the circumference of the inner mandrel 118, and a second conduit 304*b* that extends from the first conduit 304*a* and axially along a portion of the axial length of the inner mandrel 118. The annulus port 226 places the valve chamber 130 in fluid communication with the annulus 104, and the valve port 128 places the valve chamber 130 in fluid communication with the tubing string bore 108, as generally described above.

Embodiments disclosed herein include:

A. A pressure-operated valve assembly includes an outer mandrel defining a tubing string bore, wherein an annulus is defined between the outer mandrel and an inner wall of a wellbore when arranged within the wellbore, an inner mandrel arranged within the tubing string bore, a first atmospheric chamber at least partially defined by the outer mandrel, and a second atmospheric chamber at least partially defined between the outer and inner mandrels, a valve chamber defined in the inner mandrel and in fluid communication with the tubing string bore via a valve port and further in fluid communication with the annulus via an annulus port, an atmospheric chamber port provided in the valve chamber and in fluid communication with the second atmospheric chamber via a chamber conduit, and a hydrostatically insensitive valve arranged within the valve chamber and including a piston providing a head with a first end exposed to pressure within the annulus via the annulus port and a second end exposed to pressure within the tubing string bore via the valve port, wherein the piston is movable between a first position, where the head occludes the atmospheric chamber port, and a second position, where the atmospheric chamber port is exposed and thereby allows fluid pressure within the valve chamber to communicate with the second atmospheric chamber via the chamber conduit, and wherein communicating the fluid pressure to the second atmospheric chamber causes the first atmospheric chamber to collapse.

B. A method includes conveying a pressure-operated valve assembly into a wellbore, the pressure-operated valve assembly including an outer mandrel defining a tubing string bore, and an inner mandrel arranged within the tubing string bore, a first atmospheric chamber at least partially defined by the outer mandrel, and a second atmospheric chamber at least partially defined between the outer and inner mandrels, a valve chamber defined in the inner mandrel and in fluid communication with the tubing string bore via a valve port and further in fluid communication with an annulus defined between the outer mandrel and an inner wall of the wellbore via an annulus port, an atmospheric chamber port provided in the valve chamber and in fluid communication with the second atmospheric chamber via a chamber conduit, and a hydrostatically insensitive valve arranged within the valve chamber and including a piston providing a head with a first end exposed to pressure within the annulus via the annulus port and a second end exposed to pressure within the tubing string bore via the valve port. The method further includes increasing a pressure within the tubing string bore and thereby moving the piston from a first position, where the head occludes the atmospheric chamber port, and a second position, where the atmospheric chamber port is exposed, communicating fluid pressure from the valve chamber to the second atmospheric chamber via the chamber conduit, and collapsing the first atmospheric chamber.

Each of embodiments A and B may have one or more of the following additional elements in any combination: Element 1: wherein the hydrostatically insensitive valve further comprises a plug secured within the valve chamber, and a stem extending from the first end of the head and operatively coupled to the plug with a shearable member. Element 2: wherein the plug defines an elongated channel sized to receive the stem when the piston moves to the second position. Element 3: wherein the plug interposes the second atmospheric chamber and the valve chamber. Element 4: wherein, when in the first position, the piston is pressure-balanced between the annulus and the tubing string bore as the pressure-operated valve assembly is conveyed into the wellbore. Element 5: further comprising first and second seals arranged to seal an interface between the head and the valve chamber, wherein, when the piston is in the first position, the first and second seals are arranged on opposing sides of the atmospheric chamber port and balance pressure across the atmospheric chamber port. Element 6: further comprising one or more ports defined in a sidewall of the outer mandrel, and a sliding sleeve arranged within the tubing string bore and positioned radially adjacent the one or more ports, wherein the first atmospheric chamber is defined between the outer mandrel and the sliding sleeve, and the second atmospheric chamber is defined between a combination of the outer and inner mandrels and an end of the sliding sleeve, wherein the sliding sleeve is movable between a closed position, where the sliding sleeve occludes the one or more ports, and an open position, where the one or more ports are exposed and facilitate fluid communication between the tubing string bore and the annulus, and wherein collapsing the first atmospheric chamber moves the sliding sleeve to the open position. Element 7: further comprising a shear pin that secures the sliding sleeve in the closed position until the shear pin is sheared. Element 8: further comprising a sliding projectile sleeve arranged within the tubing string bore and providing a landing seat, and a wellbore projectile conveyable within the tubing string bore until locating and landing on the landing seat, wherein, once the wellbore projectile lands on the landing seat, increasing a pressure within the tubing string bore moves the sliding projectile sleeve and thereby exposes the valve port to facilitate fluid communication into the valve chamber from the tubing string bore. Element 9: wherein one end of the valve chamber communicates with a through port in fluid communication with a downhole mechanism, and wherein increasing a pressure within the valve chamber causes the downhole mechanism to actuate. Element 10: wherein the annulus port is defined in the inner mandrel. Element 11: wherein the annulus port is provided in aligned and contiguous conduits defined in the outer and inner mandrels.

Element 12: wherein increasing the pressure within the tubing string bore comprises conveying fluid pressure into the valve chamber via the valve port, and acting on the second end of the head with the fluid pressure and thereby moving the piston from the first position to the second position. Element 13: wherein the hydrostatically insensitive valve further includes a plug secured within the valve chamber, and a stem extending from the first end and operatively coupled to the plug with a shearable member, and wherein increasing the pressure within the tubing string bore further comprises increasing the pressure until reaching a predetermined pressure corresponding to a shear limit of the shearable member, shearing the shearable member and thereby freeing the piston from the plug, and advancing the stem into an elongate channel defined in the plug as the piston moves to the second position. Element 14: further comprising exposing the piston to pressure in the annulus and the tubing string bore simultaneously as the pressure-operated valve assembly is conveyed into the wellbore, and thereby maintaining the piston in pressure balance between the annulus and the tubing string bore. Element 15: wherein, when the piston is in the first position, the method further comprises sealing a first interface between the head and the valve chamber with a first seal arranged on a first side of the atmospheric chamber port, sealing a second interface between the head and the valve chamber with a second seal arranged on a second side of the atmospheric chamber port, and balancing pressure across the atmospheric chamber port with the first and second seals. Element 16: wherein the pressure-operated valve assembly further includes one or more ports defined in a sidewall of the outer mandrel, and a sliding sleeve arranged within the tubing string bore and positioned radially adjacent the one or more ports, and wherein collapsing the first atmospheric chamber comprises moving the sliding sleeve from a closed position, where the sliding sleeve occludes the one or more ports, to an open position, where the one or more ports are exposed, and flowing a fluid through the one or more ports and between the tubing string bore and the annulus. Element 17: wherein the pressure-operated valve assembly further includes a sliding projectile sleeve arranged within the tubing string bore and providing a landing seat, and wherein increasing the pressure within the tubing string bore is preceded by conveying a wellbore projectile into the tubing string bore and landing the wellbore projectile on the landing seat, and increasing the pressure within the tubing string bore and thereby moving the sliding projectile sleeve to expose the valve port and facilitate fluid communication into the valve chamber from the tubing string bore. Element 18: wherein one end of the valve chamber communicates with a through port in fluid communication with a downhole mechanism, and wherein increasing the pressure within the tubing string bore includes conveying fluid pressure to the downhole mechanism via the through port, and actuating the downhole mechanism with the fluid pressure.

By way of non-limiting example, exemplary combinations applicable to A and B include: Element 1 with Element 2; Element 1 with Element 3; Element 6 with Element 7; and Element 6 with Element 8.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

The invention claimed is:

1. A pressure-operated valve assembly, comprising:

an outer mandrel defining a tubing string bore, wherein an annulus is defined between the outer mandrel and an inner wall of a wellbore when arranged within the wellbore;

an inner mandrel arranged within the tubing string bore;

a first atmospheric chamber at least partially defined by the outer mandrel, and a second atmospheric chamber at least partially defined between the outer and inner mandrels;

a valve chamber defined in the inner mandrel and in fluid communication with the tubing string bore via a valve port and further in fluid communication with the annulus via an annulus port;

an atmospheric chamber port provided in the valve chamber and in fluid communication with the second atmospheric chamber via a chamber conduit;

a hydrostatically insensitive valve arranged within the valve chamber and including a piston providing a head with a first end exposed to pressure within the annulus via the annulus port and a second end exposed to pressure within the tubing string bore via the valve port; and a sliding sleeve arranged axially between the first and second atmospheric chambers, wherein the piston is movable between a first position, where the head occludes the atmospheric chamber port, and a second position, where the atmospheric chamber port is exposed and thereby allows fluid pressure within the valve chamber to communicate with the second atmospheric chamber via the chamber conduit, and wherein communicating the fluid pressure to the second atmospheric chamber causes the sliding sleeve to shift and thereby reduce a volume of the first atmospheric chamber.

2. The assembly of claim 1, wherein the hydrostatically insensitive valve further comprises:

a plug secured within the valve chamber; and a stem extending from the first end of the head and operatively coupled to the plug with a shearable member.

3. The assembly of claim 2, wherein the plug defines an elongated channel sized to receive the stem when the piston moves to the second position.

4. The assembly of claim 2, wherein the plug interposes the second atmospheric chamber and the valve chamber.

5. The assembly of claim 1, wherein, when in the first position, the piston is pressure-balanced between the annulus and the tubing string bore as the pressure-operated valve assembly is conveyed into the wellbore.

6. The assembly of claim 1, further comprising first and second seals arranged to seal an interface between the head and the valve chamber, wherein, when the piston is in the first position, the first and second seals are arranged on opposing sides of the atmospheric chamber port and balance pressure across the atmospheric chamber port.

7. The assembly of claim 1, further comprising:

one or more ports defined in a sidewall of the outer mandrel, wherein the sliding sleeve is arranged within the tubing string bore and positioned radially adjacent the one or more ports, wherein the first atmospheric chamber is defined between the outer mandrel and the sliding sleeve, and the second atmospheric chamber is defined between a combination of the outer and inner mandrels and an end of the sliding sleeve, wherein the sliding sleeve is movable between a closed position, where the sliding sleeve occludes the one or more ports, and an open position, where the one or more ports are exposed and facilitate fluid communication between the tubing string bore and the annulus, and wherein reducing the volume of the first atmospheric chamber moves the sliding sleeve to the open position.

8. The assembly of claim 7, further comprising a shear pin that secures the sliding sleeve in the closed position until the shear pin is sheared.

9. The assembly of claim 7, further comprising:

a sliding projectile sleeve arranged within the tubing string bore and providing a landing seat; and a wellbore projectile conveyable within the tubing string bore until locating and landing on the landing seat, wherein, once the wellbore projectile lands on the landing seat, increasing a pressure within the tubing string bore moves the sliding projectile sleeve and thereby exposes the valve port to facilitate fluid communication into the valve chamber from the tubing string bore.

10. The assembly of claim 1, wherein one end of the valve chamber communicates with a through port in fluid communication with a downhole packer, and wherein increasing a pressure within the valve chamber causes the downhole packer to actuate.

11. The system of claim 1, wherein the annulus port is defined in the inner mandrel.

12. The system of claim 1, wherein the annulus port is provided in aligned and contiguous conduits defined in the outer and inner mandrels.

13. A method, comprising:

conveying a pressure-operated valve assembly into a wellbore, the pressure-operated valve assembly including:

an outer mandrel defining a tubing string bore, and an inner mandrel arranged within the tubing string bore;

a first atmospheric chamber at least partially defined by the outer mandrel, and a second atmospheric chamber at least partially defined between the outer and inner mandrels;

a valve chamber defined in the inner mandrel and in fluid communication with the tubing string bore via a valve port and further in fluid communication with an annulus defined between the outer mandrel and an inner wall of the wellbore via an annulus port;

an atmospheric chamber port provided in the valve chamber and in fluid communication with the second atmospheric chamber via a chamber conduit;

a hydrostatically insensitive valve arranged within the valve chamber and including a piston providing a head with a first end exposed to pressure within the annulus via the annulus port and a second end exposed to pressure within the tubing string bore via the valve port; and a sliding sleeve arranged axially between the first and second atmospheric chambers;

increasing a pressure within the tubing string bore and thereby moving the piston from a first position, where the head occludes the atmospheric chamber port, and a second position, where the atmospheric chamber port is exposed;

communicating fluid pressure from the valve chamber to the second atmospheric chamber via the chamber conduit; and shifting the sliding sleeve in response to communicating the fluid pressure to the second atmospheric chamber and thereby reducing a volume of the first atmospheric chamber.

14. The method of claim 13, wherein increasing the pressure within the tubing string bore comprises:

conveying fluid pressure into the valve chamber via the valve port; and acting on the second end of the head with the fluid pressure and thereby moving the piston from the first position to the second position.

15. The method of claim 13, wherein the hydrostatically insensitive valve further includes a plug secured within the valve chamber, and a stem extending from the first end and operatively coupled to the plug with a shearable member, and wherein increasing the pressure within the tubing string bore further comprises:

increasing the pressure until reaching a predetermined pressure corresponding to a shear limit of the shearable member;

shearing the shearable member and thereby freeing the piston from the plug; and advancing the stem into an elongate channel defined in the plug as the piston moves to the second position.

16. The method of claim 13, further comprising exposing the piston to pressure in the annulus and the tubing string bore simultaneously as the pressure-operated valve assembly is conveyed into the wellbore, and thereby maintaining the piston in pressure balance between the annulus and the tubing string bore.

17. The method of claim 13, wherein, when the piston is in the first position, the method further comprises:

sealing a first interface between the head and the valve chamber with a first seal arranged on a first side of the atmospheric chamber port;

sealing a second interface between the head and the valve chamber with a second seal arranged on a second side of the atmospheric chamber port; and balancing pressure across the atmospheric chamber port with the first and second seals.

18. The assembly of claim 13, wherein the pressure-operated valve assembly further includes one or more ports defined in a sidewall of the outer mandrel, wherein the sliding sleeve is arranged within the tubing string bore and positioned radially adjacent the one or more ports, and wherein reducing the volume of the first atmospheric chamber comprises:

moving the sliding sleeve from a closed position, where the sliding sleeve occludes the one or more ports, to an open position, where the one or more ports are exposed; and flowing a fluid through the one or more ports and between the tubing string bore and the annulus.

19. The method of claim 13, wherein the pressure-operated valve assembly further includes a sliding projectile sleeve arranged within the tubing string bore and providing a landing seat, and wherein increasing the pressure within the tubing string bore is preceded by:

conveying a wellbore projectile into the tubing string bore and landing the wellbore projectile on the landing seat; and increasing the pressure within the tubing string bore and thereby moving the sliding projectile sleeve to expose the valve port and facilitate fluid communication into the valve chamber from the tubing string bore.

20. The method of claim 13, wherein one end of the valve chamber communicates with a through port in fluid communication with a downhole packer, and wherein increasing the pressure within the tubing string bore includes:

conveying fluid pressure to the downhole mechanism via the through port; and actuating the downhole mechanism with the fluid pressure.

* * * * *